US005588594A

United States Patent [19]

Kah, Jr.

[11] Patent Number: 5,588,594

[45] Date of Patent: Dec. 31, 1996

[54] ADJUSTABLE ARC SPRAY NOZZLE

[76] Inventor: Carl L. C. Kah, Jr., 778 Lakeside Dr., North Palm Beach, Fla. 33408

[21] Appl. No.: 383,073

[22] Filed: Feb. 3, 1995

[51] Int. Cl.[6] ..... B05B 1/32; B05B 15/02

[52] U.S. Cl. ..... 239/107; 239/451

[58] Field of Search ..... 239/453, 456, 239/458, DIG. 1, 106–109, 459

[56] References Cited

U.S. PATENT DOCUMENTS

| | | | |
|---|---|---|---|
| D. 296,464 | 1/1988 | Marmol et al. | D23/213 |
| 4,579,285 | 4/1986 | Hunter | 239/DIG. 1 X |
| 5,050,800 | 9/1991 | Lamar | 239/DIG. 1 X |
| 5,058,806 | 10/1991 | Rupar | 239/DIG. 1 X |
| 5,215,254 | 6/1993 | Haruch | 239/107 |
| 5,322,223 | 6/1994 | Hadar | 239/DIG. 1 X |

*Primary Examiner*—Kevin Weldon
*Attorney, Agent, or Firm*—Jack N. McCarthy

[57] ABSTRACT

An adjustable arc spray nozzle assembly is set forth which includes a cylindrical housing member with an arc set flow control member coacting therewith to provide an adjustable arc of flow directed outwardly by a deflector. The adjustable arc of flow is achieved by a unique interaction between a radially spiraled outlet opening and an axially spiraled and sloped member. The configuration facilitates easy cleaning of the flow control area while the sprinkler is operating, and provides ease of manufacture and assembly.

20 Claims, 3 Drawing Sheets

ADJUSTABLE ARC SPRAY NOZZLE

DESCRIPTION

1. Technical Field

This invention relates to adjustable arc of coverage nozzles to provide a water spray precipitation over a setable area of coverage.

2. Background Art

My U.S. Pat. No. 5,148,990 issued Sep. 22, 1992 discloses prior art for adjustable arc of coverage spray nozzle sprinklers. Other references cited are the following: U.S. Pat. Nos. 4,579,285; 4,850,538; and 5,058,806. The prior art sprinklers require the water to be turned on to identify which sprinklers in a system are clogged or not spraying properly due to dirt. Then the water must be turned off, and defective sprinklers disassembled and cleaned, reassembled and the water then again turned on to verify proper operation.

3. Disclosure of Invention

It is a primary objective of this invention to provide a simple adjustable arc of coverage spray nozzle which can be easily cleaned during operation without disassembly and is easy and inexpensive to manufacture. The adjustable arc of flow is achieved by a unique interaction between a radially spiraled opening and an axially spiraled and sloped member. The radial spiral provides an increased opening capability for clearing dirt if the axial spiraled coacting member is displaced to allow any accumulated dirt to be cleared during operation without disassembly of the spray nozzle.

The slope of the axially spiraled and sloped member can be changed to give a higher or lower flow rate and still fit with the same sprinkler housing outlet hole. When this member is also used as the spray deflector the lower spray angles give the lower flow rates which is what is desired for the shorter range of coverage provided by the lower spray angles and various spray angle spray nozzles can be manufactured by changing only the one part.

BEST MODE FOR CARRYING OUT THE INVENTION

Figure 1:
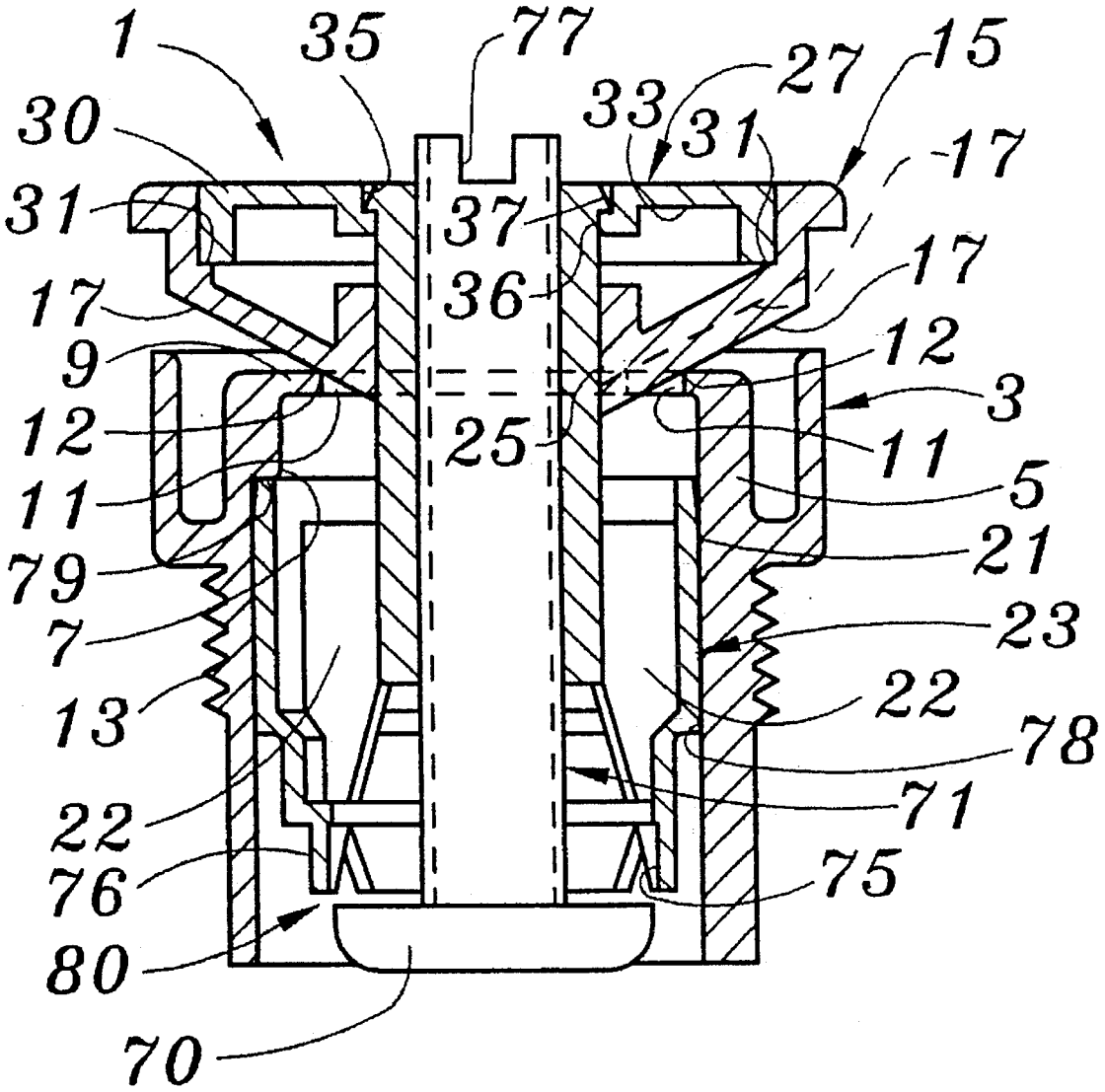
FIG. 1 is a side elevation view of the adjustable arc of coverage spray nozzle with the cylindrical housing and the adjustable arc and flow deflector member in cross-section and shown in its zero degree setable position.

A basic spray nozzle assembly 1 with adjustable arc of coverage is shown in FIG. 1. It has only two main parts to provide an adjustable arc of coverage spray precipitation pattern. The two main parts are:

(1) a cylindrical housing 3, with outlet opening 11, and (2) an arc set flow control member and deflector, 15.

The cylindrical housing 3 is defined by an outer circular wall 5, having an inner surface 7 and an outlet end closure top wall 9 with a radially spiraled outlet opening, or hole, 11 therethrough. A threaded skirt 13 for attachment to a member for supply of pressurized water extends downward. The arc set flow control member 15 has a sloped axially spiraled surface 17 which co-acts with the radially spiraled housing outlet hole 11 to provide a sealable rotational setable arcuate exit opening 19 from approximately zero to 360 degrees.

In FIG. 1 this arc set flow control member 15 is shown mounted on the top of the housing 3 with its sloped axially spiraled surface 17 protruding downward into the radially spiraled housing outlet hole 11.

Figure 3:
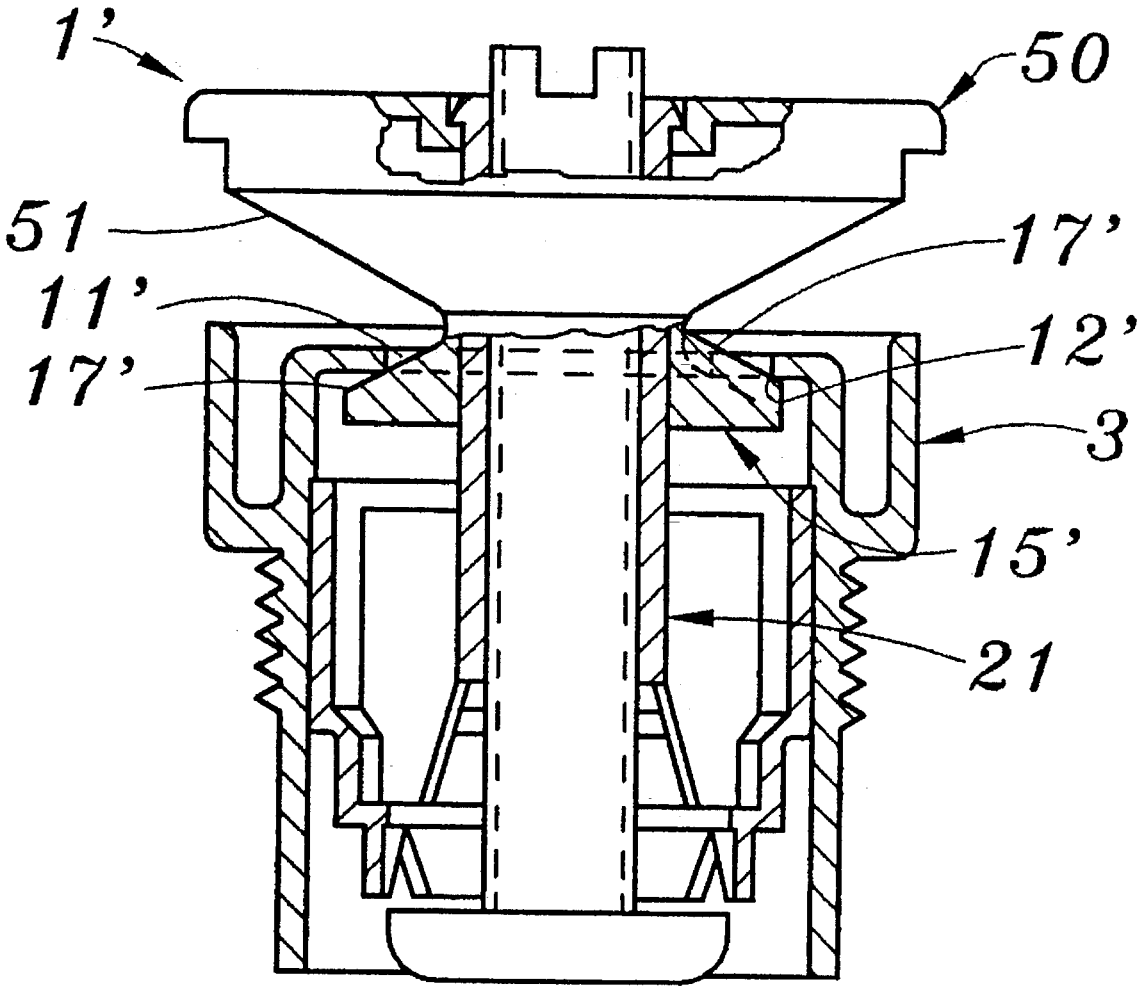
FIG. 3 is a cross-sectional side elevation view of an alternate configuration in which the arc set member is inside the housing and a separate deflector is mounted on the top of the arc set member above the spray nozzle housing, this alternate configuration is shown in its zero degree setable position.

An alternate configuration is shown as spray nozzle assembly 1' in FIG. 3 in which the arc set flow control member 15' is shown mounted inside the cylindrical housing 3 with its axially spiraled sloped surface 17' protruding upwardly into the cylindrical housing 3 radially spiraled outlet hole 11'. This alternate configuration will be later discussed.

For the configuration of arc setable spray nozzles shown in FIG. 1 the arc set flow control member 15 also serves as a flow deflector to dispense the water coming through the adjustable arcuate opening 19 between the arc set flow control member 15 axially spiraled surface 17 and the edge 12 of the housing outlet hole 11 outwardly from the spray nozzle assembly 1 at an angle established by the slope angle of surface 17 of the arc set flow control member 15.

The arc set flow control member 15 as shown is held in axial alignment with the cylindrical housing 3 by a round shaft 21 extending upwardly from an insert 23 positioned within the cylindrical housing 3 by radial support ribs 22. A round hole 25 in the center of the arc set flow control member 15 serves as an axial bearing for the arc set flow control member, and deflector, 15.

The arc set flow control member 15 in the configuration of FIG. 1 must be spring loaded downwardly against the edge 12 of the outlet hole 11 of housing 3 against the water pressure in the housing. This is accomplished by a washer shaped member 27 which is snapped onto the top of the center axial shaft 21, the outer circumferential edge 30 of member 27 is pre-loaded downwardly against a recessed annular surface 31 in the top of the arc set flow control member 15. The washer radial wall 33 acts as a flexible member to provide the required downward force once it has been deflected from its free form and retained in position by snap lips 35 which are molded onto the top of axial shaft 21 and snap over the edge 37 of a recessed center hole 36, of washer member 29.

The radially 14 spiraled outlet hole 11 of the housing 3 provides the feature of easy cleaning with the spray nozzle assembly 1 operating without disassembly. This is accomplished by manually pulling up on the arc set flow control member 15 against the force exerted by washer member 29 unseating the surface 17 of valving member 15 from edge 12 to allow large dirt particles to be blown through during operation without disassembly. When the member 15 is released, normal spray operation is restored without having had to turn off the water, disassemble the sprinkler nozzle, clean it, reassemble the nozzle and turn the water back on to verify proper operation.

The uniquely simple action of the basic spray nozzle assembly 1 is as follows for a functional Sprinkler although other angles and slots sizes may be selected. The spring force of washer member 27, against the arc set flow control, and deflector, member 15 is selected to exceed the force of the operating water pressure on the arc set flow control member 15. To force its sloped and spiraled surface 17 onto edge 12 of the radially spiraled outlet opening 11 would require only about 5 lbs. of force even for an operating pressure of 100 psi.

The axial displacement of the arc set flow control member 15 during rotation from fully closed to approximately 360 degrees is approximately 0.034 inches for a typical configuration as shown in FIG. 1 as the larger diameter downwardly axially displaced portion of the surface 17 of the arc set flow control member 15 rides around edge 12 of the radially spiraled housing outlet hole 11 to the smaller diameter of this radially spiraled housing outlet hole 11.

As shown the arcuate opening 19 for a typical higher flow rate spray nozzle is 0.030 inches in height. The arcuate opening height which is provided by the interaction of a radially spiraled housing outlet hole 11 and a sloped axially spiraled surface is a geometric result of the size of the step 14 of the radial spiral between its ends 90 and 92. The slope angle of the axially spiraled surface 17 which also serves as the spray deflector in the configuration shown in FIG. 1 is selected to provide the desired range characteristics for the spray nozzle assembly. The slope angle shown is 28 degrees which is the desired best spray angle for range in air with some wind. The radial step 14 of the housing outlet hole 11 is selected for the best combination with other standard spray angles of 10, 12, 15 degrees to provide the appropriate flow rates. Once these features are picked, the axial spiral displacement necessary to provide circumferential contact between edge 12 of the radial spiral and surface 17 of the axial spiral and sloped surface is used for each of the different slope angles.

An arcuate opening 19 of the proper width is achieved because the upperly displaced surface of the axially spiraled surface 17 is rotated back over the radial spiral opening as the lower portion of the axial spiral 17 is rotated to open the arcuate opening, on slot 19. The sloped surface is continuously being lifted as the arc set member is being rotated but the portion covering the larger portion of the radial spiral opening height remains the same as it is riding on edge 12 so that the slot height remains constant during arc setting, but can be made to increase for the angle setting of greater than 180 degrees by varying the shape of the slope angle at radii less than the small radius of the radial spiraled opening 11. The slope angle at this location can be used to increase the arcuate opening 19 height for angular settings larger than 180 degrees to compensate for the small reduction in mean slot radius from the axial center of the spray nozzle. The arcuate opening can be varied for angle settings of less than 180 degrees by changing the slope angle at radii greater than the minium radius of the radial spiral opening.

Figure 2A:
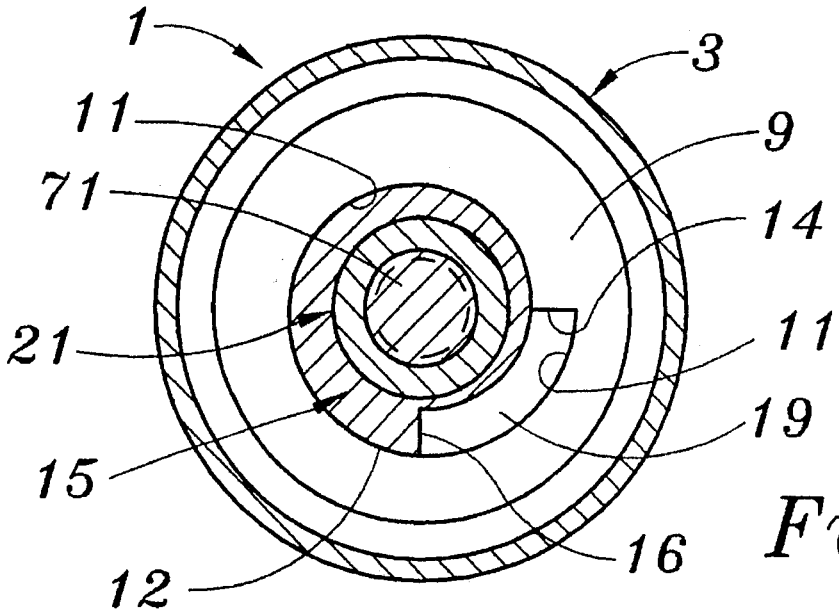
FIG. 2A is a top sectional view of the cylindrical housing showing the radially spiraled outlet hole and in place sectioned arc set member positioned for 90 degree spray pattern opening.
Figure 2B:
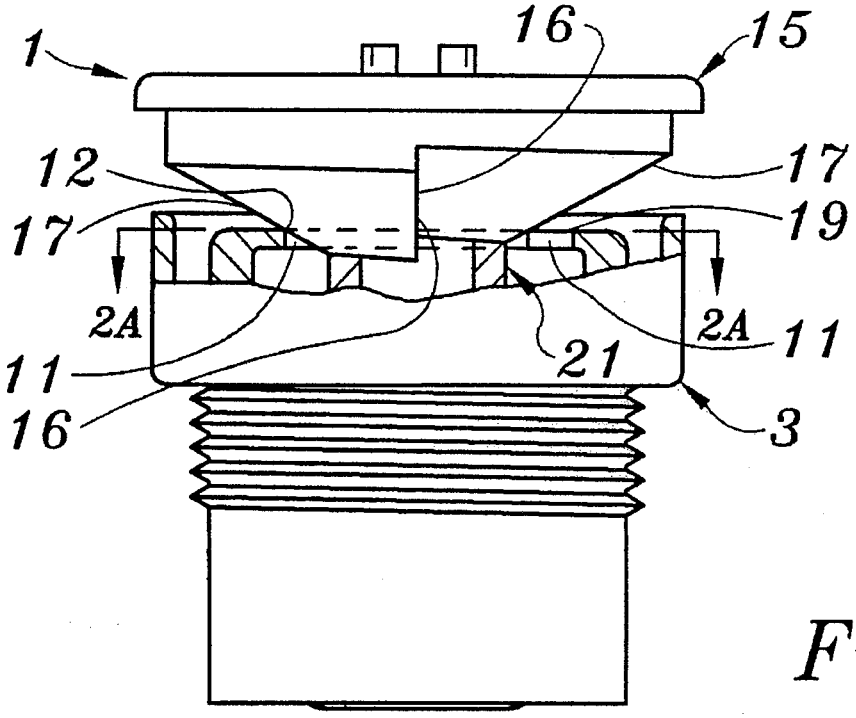
FIG. 2B is a matching position to FIG. 2A showing a partially sectioned housing but with the arc set flow deflector member not sectioned so that the axially spiraled and sloped surfaces can be clearly seen.

FIG. 2A is a top sectional view of the spray nozzle housing with the arc set flow control member 15 in place taken at the top surface level of the outlet hole 11 of the housing and with the arc set flow control member 15 set at 90 degrees of opening. The radially spiraled housing outlet hole 11 is clearly shown. The matching position side elevation is shown in FIG. 2B partially sectioned but with the arc set flow control, and deflector member, 15 not sectioned so that the axial spiral step 16 can be seen in its proper relationship to the radial spiraled hole 11.

FIG. 3 shows an alternate configuration in which the arc set flow control member 15' is shown mounted upside down inside the cylindrical housing 3 with its axially spiraled sloped surface 17' protruding upwardly into the radially spiraled outlet hole 11'. A separate spray deflector piece 50 is placed on the outside top of the cylindrical housing 3 and is rotationally connected to the internal arc set flow control member 15' to allow the arc set flow control member 15' to be rotationally set from outside the nozzle housing. The spray deflector 50 can have a matching spiral surface 51 at the desired spray angle.

In this configuration water pressure inside the nozzle housing biases the sloped surface 17' of the arc set flow control member 15' into seating contact with inside edge 12' of the radially spiraled housing outlet hole 11'. Both the arc set flow control member 15' and the added spray deflector 50 are retained in rotational axial alignment on the center stationary shaft 21' by the radial ribs 22 of the housing insert 23. A snap cover 55 is provided to prevent the flow deflector 50 from coming off but no downward spring bias is required.

The flow deflector 50 and arc set flow control member 15' are allowed space under arc set flow control member 15' to the radial support ribs 22 to be manually forced downward from the outside during sprinkler operation to allow increasing the slot height for cleaning any dirt particle that might have gotten through the nozzle to the flow control slot area.

As shown in FIG. 1 the ribbed housing insert 23 also serves as the stationary part of a spray range pressure throttling flow valve 80 upstream of the spray flow discharge opening 19. This upstream flow pressure throttling valve 80 is created between the head 70 of a thread screw 71 extending up through the center stationary shaft 21 and the inside surface 75 of a lower skirt 76 on the housing insert 23. As the screw is turned down or up by slot 77 on the top of the spray nozzle the pressure throttling valve is further opened or closed to change the range of the nozzle spray pattern.

This is an attractive configuration over prior art in that the sprinkler throttling valve 80 may be adjusted from the top by slot 77 of the throttling screw 71 without affecting the arc set flow control member 15 or 15' and deflector 50.

The housing insert 23 is prevented from rotating by a flat side as at 78 and is held in the proper vertical position by step 79 in the inside of housing 3.

I claim:

1. An adjustable orifice sprinkler spray nozzle assembly, comprising fixed housing means defining a passage having an inlet for attachment to a source of pressurized water and an outlet defined by a spiraled edge having radially offset ends for dispensing water, said outlet having an axis, said radially offset ends being connected; and moveable means including means defining a sloped axially spiraled surface cooperating with said spiraled edge of said fixed housing means for defining an adjustable arcuate dispensing orifice adjustable about the axis of said outlet.

2. An adjustable orifice sprinkler spray nozzle assembly as set forth in claim 1 wherein a spray range pressure throttling flow valve is positioned in said inlet upstream of the adjustable arcuate dispensing orifice.

3. An adjustable orifice sprinkler spray nozzle assembly as set forth in claim 1 including said fixed housing means having an insert fixed therein to receive and properly position said moveable means with said fixed housing means.

4. An adjustable orifice sprinkler spray nozzle assembly as set forth in claim 3 wherein a shaft extends between said insert and said moveable means.

5. An adjustable orifice sprinkler spray nozzle assembly as set forth in claim 3 wherein said insert has ribs between the inlet and the outlet of said fixed housing means for the flow of water through said insert.

6. An adjustable orifice sprinkler spray nozzle assembly, comprising fixed housing means defining a passage having an inlet for attachment to a source of pressurized water and an outlet defined by an adjustable arcuate dispensing orifice; said adjustable arcuate dispensing orifice being formed by the interaction between a radially spiraled opening and an axially spiraled and sloped surface.

7. The adjustable orifice sprinkler spray nozzle assembly as set forth in claim 6 wherein said radially spiraled opening and said axially spiraled and sloped surface are biased into contact with each other, means are provided to allow for manually unseating them to increase flow area momentarily for clearing dirt from the adjustable orifice sprinkler spray nozzle assembly.

8. A sprinkler spray nozzle assembly comprising a fixed housing means defining a passage having an inlet for attachment to a source of pressurized water, said fixed housing having an outlet defined by an opening, and a flow control means cooperating with said outlet to establish a defined flow area, said flow control means being biased into said outlet so that said flow control means can be manually displaced upwardly to enlarge said defined flow area to release dirt particles during sprinkler operation, biasing means extend between the fixed housing means and flow control means to bias them together for sealing, said biasing means is a flexible washer.

9. An adjustable orifice sprinkler spray nozzle assembly, comprising fixed housing means defining a passage having an inlet for attachment to a source of pressurized water and an outlet defined by a spiraled edge having connected offset ends for dispensing water, a stationary round shaft in said housing means extends out of said outlet, a moveable member slideable and rotatable on said stationary round shaft, said moveable member having an axially spiraled sloped surface, said sloped surface extending into said outlet and cooperating with said spiraled edge for defining an adjustable arcuate dispensing orifice.

10. An adjustable orifice sprinkler spray nozzle assembly as set forth in claim 9 wherein positioning means act between said fixed housing means and said moveable member to hold said sloped surface and said spiraled edge together for sealing.

11. An adjustable orifice sprinkler spray nozzle assembly as set forth in claim 10 wherein said positioning means provides a force to hold said sloped surface and said spiraled edge together for sealing.

12. An adjustable orifice sprinkler spray nozzle assembly as set forth in claim 11 wherein said positioning means is pre-loaded to act between said stationary round shaft and said moveable member.

13. An adjustable orifice sprinkler spray nozzle assembly as set forth in claim 12 wherein said positioning means is a flexible washer, said flexible washer having an inner and outer edge, said moveable member having a top portion, said top portion having a recessed annular surface, the top of said stationary round shaft having holding lip means, said flexible washer having its outer edge located against said recessed annular surface and its inner edge located against said holding lip means holding said sloped surface and said spiraled edge together.

14. An adjustable orifice sprinkler spray nozzle assembly as set forth in claim 9 wherein a spray range pressure throttling flow valve is positioned in said inlet upstream of the adjustable arcuate dispensing orifice.

15. An adjustable orifice sprinkler spray nozzle assembly as set forth in claim 14 wherein said stationary round shaft has two ends, a threaded screw extending through said stationary round shaft from one end to the other, said threaded screw having two ends, means connecting said flow valve to one end of said threaded screw, the other end of said threaded screw having means for turning said threaded screw to move said flow valve to change the flow.

16. An adjustable orifice sprinkler spray nozzle assembly, comprising fixed housing means defining a passage having an inlet for attachment to a source of pressurized water and an outlet defined by a spiraled edge having connected offset ends for dispensing water, a moveable member having an axially spiraled sloped surface, said spiraled sloped surface extending into said spiraled edge of said outlet and cooperating with said spiraled edge for defining an adjustable arcuate dispensing orifice, said fixed housing means having an insert fixed therein to receive and properly position said moveable member with said fixed housing means, said insert having a shaft up through the outlet for mounting the moveable member.

17. An adjustable orifice sprinkler spray nozzle assembly as set forth in claim 16 wherein said axially spiraled sloped surface above said spiraled edge of said outlet acts as a flow deflector.

18. An adjustable orifice sprinkler spray nozzle assembly as set forth in claim 16 including means for manually displacing said moveable member on said shaft to enlarge said adjustable arcuate dispensing orifice to release dirt particles during sprinkler operation.

19. An adjustable orifice sprinkler spray nozzle assembly comprising a fixed housing means defining a passage having an inlet for attachment to a source of pressurized water, said fixed housing having an outlet defined by a spiraled opening, an arcuate flow control means cooperating with said outlet to establish a defined arcuate flow area, means biasing said arcuate flow control means into said outlet so that said arcuate flow control means can be lifted upwardly to enlarge said defined flow area to release dirt particles during operation of the adjustable arcuate orifice sprinkler, said biasing means acting between the housing and said arcuate flow control means to hold them together during normal operation.

20. An adjustable orifice sprinkler spray nozzle assembly as set forth in claim 19 wherein said arcuate flow control means has deflector means for deflecting flow from said arcuate flow area.

* * * * *